United States Patent [19]

Odenthal et al.

[11] Patent Number: 4,500,809

[45] Date of Patent: Feb. 19, 1985

[54] ELECTRON GUN HAVING A LOW CAPACITANCE CATHODE AND GRID ASSEMBLY

[75] Inventors: Conrad J. Odenthal, Portland; Dennis D. Askew, Gresham, both of Oreg.

[73] Assignee: Tektronix, Inc., Beaverton, Oreg.

[21] Appl. No.: 417,298

[22] Filed: Sep. 13, 1982

Related U.S. Application Data

[63] Continuation of Ser. No. 273,829, Jun. 15, 1981, abandoned, which is a continuation of Ser. No. 28,473, Apr. 9, 1979, abandoned.

[51] Int. Cl.[3] ..... H01J 29/48

[52] U.S. Cl. ..... 313/444; 313/447; 313/448; 313/451; 313/449; 313/456

[58] Field of Search ..... 313/444, 447, 448, 449, 313/451, 456

[56] References Cited

U.S. PATENT DOCUMENTS

| | | | |
|---|---|---|---|
| 2,310,811 | 2/1943 | Schantl et al. | 313/451 |
| 2,443,916 | 6/1948 | Kelar | 313/451 |
| 2,458,962 | 1/1949 | Shelton et al. | 313/451 X |
| 2,540,621 | 2/1951 | Johnson | 313/451 X |

FOREIGN PATENT DOCUMENTS

| | | |
|---|---|---|
| 763951 | 12/1956 | United Kingdom . |
| 1097588 | 1/1968 | United Kingdom . |
| 1145953 | 3/1969 | United Kingdom . |
| 1417185 | 12/1975 | United Kingdom . |

OTHER PUBLICATIONS

Moss et al., "High Resolution Cathode Ray Tube", ASD TDR, 62-739, Oct. 1962.

*Primary Examiner*—Eugene R. LaRoche
*Attorney, Agent, or Firm*—John D. Winkelman

[57] ABSTRACT

A cathode and grid assembly includes a first grid of small diameter secured to a planar inner surface of a ceramic means and over a central opening in the ceramic means and a second grid having a first planar section secured to a planar outer surface of the ceramic means, a second planar section positioned within the central opening and a frustum of a cone section interconnecting the first and second planar sections with the frustum of a cone section extending along a frustum of a cone outer surface of the ceramic means.

5 Claims, 2 Drawing Figures

ELECTRON GUN HAVING A LOW CAPACITANCE CATHODE AND GRID ASSEMBLY

CROSS-REFERENCE TO RELATED APPLICATIONS

This is a continuation of application Ser. No. 273,829 filed June 15, 1981, now abandoned, which was a continuation of application Ser. No. 28,473 filed Apr. 9, 1979, now abandoned.

BACKGROUND OF THE INVENTION

In high frequency electron discharge devices such as cathode ray tubes, the capacitance between the control grid and the accelerating grid of an electron gun must present a small area to the other electrodes in the electron gun in order to reduce the input capacitance to enable the high frequency signal to be impressed on the control grid for high frequency operation.

U.S. Pat. No. 2,458,962 discloses a grid assembly for cathode ray tubes which comprises first and second grid members in the form of a frustum of a cone. The first grid member is closely positioned next to the cathode and the second grid member has an inner section disposed within the first grid member but spaced therefrom. This arrangement presents a large area thereby increasing the capacitance and is not suitable for high frequency cathode ray tubes.

The grid assembly in U.S. Pat. No. 2,540,621 is of similar construction to that of U.S. Pat. No. 2,458,962 except that the first grid member does not have a frustrum of a cone configuration; however, the metal areas of the first and second grid members opposite each other present a large area such that increased capacitance results thereby rendering this grid assembly unsuitable for high frequency operation.

The grid assembly in U.S. Pat. No. 2,443,916 includes a small first grid member which is welded to an eyelet that secures the first grid member to a ceramic mounting member onto which the second grid member is also mounted and spaced from the first grid members. This arrangement provides a large surface area that results in a large input capacitance which is a serious disadvantage to high frequency operation.

SUMMARY OF THE INVENTION

The present invention relates to electron discharge devices and more particularly to an electron gun structure having an improved low capacitance grid assembly for high frequency cathode ray tubes.

The present invention is realized by securing a small diameter control grid to an inner planar surface of an annular ceramic member and an outer planar section of a focussing grid to an outer planar surface of the ceramic member. Another outer surface in the form of a frustum of a cone is provided as part of the ceramic member and the accelerating grid has an inner planar section disposed adjacent to the control grid with the outer and inner planar sections of the accelerating grid being connected by a frustum of a cone section extending along the frustum of cone surface of the ceramic member. The area presented by this grid assembly results in a small input capacitance to enable high frequency signals to be impressed onto the control grid for high frequency operation. The spacing and alignment of the grids relative to each other and to the cathode is very accurate and the apertures in the grids are formed therein after the grids have been secured to the ceramic member so that their alignment is very accurate. The cathode and grid assembly is mounted via the accelerating grid being secured to a mounting wafer.

An object of the present invention is to provide a low capacitance grid assembly as part of an electron gun for a cathode ray tube.

Another object of the present invention is the provision of a low capacitance grid assembly which presents a small area to reduce the input capacitance.

A further object of the present invention is to provide a low capacitance grid assembly wherein the grid members are accurately positioned relative to each other.

An additional object of the present invention is the provision of a cathode and grid assembly wherein the grid members are accurately spaced and aligned relative to each other and the cathode is accurately positioned and aligned relative to the grid members.

A still further object of the present invention is to provide a low capacitance cathode and grid assembly which is mounted in position in a cathode ray tube as part of the electron gun via the accelerating grid member.

Still an additional object of the present invention is the provision of forming the apertures in the grids of a low capacitance grid assembly after the grids have been secured onto a ceramic member.

BRIEF DESCRIPTION OF THE DRAWING

Other objects and advantages of the present invention will be apparent from the following detailed description of a preferred embodiment thereof and from the attached drawing of which.

DETAILED DESCRIPTION OF THE INVENTION

Figure 1:
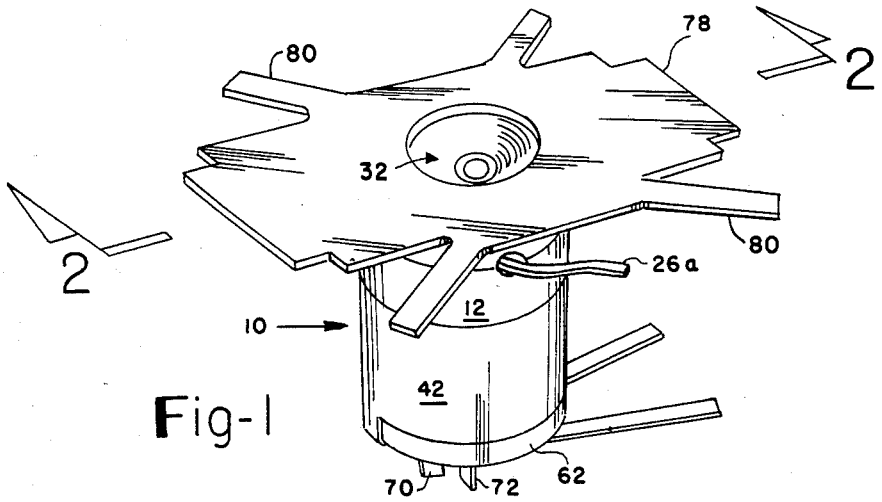
FIG. 1 is a perspective view of the cathode and grid assembly of the present invention.
Figure 2:
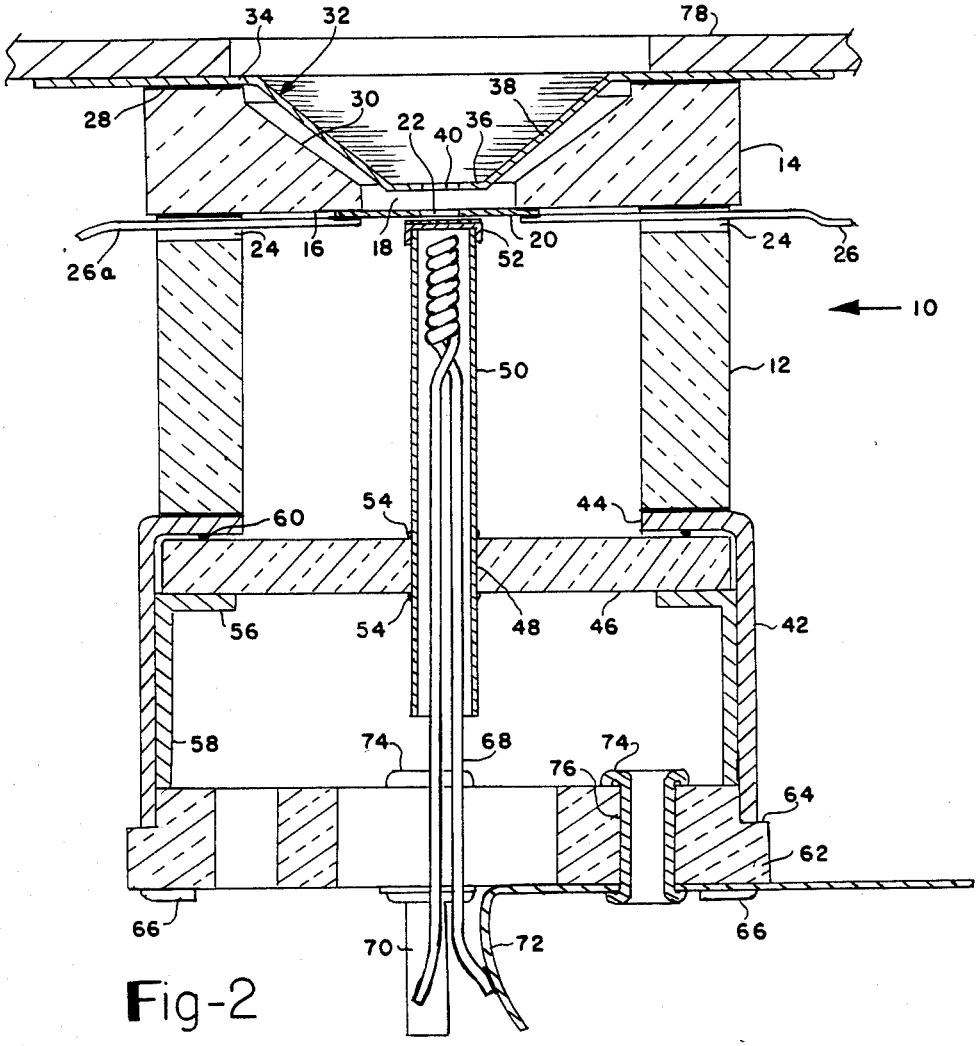
FIG. 2 is a cross-sectional view taken along the line 2—2 of FIG. 1.

As shown in FIGS. 1 and 2, a cathode and grid assembly 10 includes an annular ceramic member 12 having its upper surface secured to an inner planar surface 16 of another ceramic member 14 by a conventional brazing practice. An opening 18 is located in the center of ceramic member 14 and it has a control grid member 20 slightly larger in diameter than opening 18 tightly secured to inner surface 16. Grid member 20 is preferably brazed to inner surface 16 with braze along the entire periphery of grid member 20 or at spaced locations therealong. Grid member 20 is stainless steel that has a thickness of 0.005 inches and an aperture 22 therethrough having a diameter of 0.022 inches.

Recesses 24 are located in the upper surface of ceramic member 12 that is brazed to surface 16 to enable grid wire 26 to extend to the outside of assembly 10 from its connection with control grid member 20. Wire 26 is a thin wire and has a diameter of 0.008 inches thereby providing a high inductance and low capacitance.

Ceramic member 14 has an outer planar surface 28 and an outer surface 30 in the form of a frustum of a cone. An accelerating grid member 32 has an outer planar section 34, an inner planar section 36 and a frustum of a cone section 38 connecting sections 34 and 36 together. Section 34 is brazed to planar surface 28 in the same manner that grid member 20 is secured to inner surface 16 to secure grid member 32 in position on ceramic member 14. Section 38 conforms substantially to the configuration of a frustum of a cone surface 30 and section 28 precisely positions and aligns section 36 relative to grid member 20 so that the grid members 20 and section 36 of grid member 32 are parallel and 0.02 inches apart. Section 36 has an aperture 40 therethrough having a diameter of 0.022 inches and being accurately aligned with aperture 22. Section 36 has a diameter smaller than that of grid member 20.

In order to make certain that apertures 22 and 40 are accurately aligned, they are formed in grid members 20 and 32 after these grid members have been brazed to ceramic member 14. Apertures 22 and 40 are formed in the grid members by the conventional practice of electron discharge machining. In this way, apertures 22 and 40 are assured of being accurately aligned.

A cathode support 42 has an inturned flange 44 brazed to the bottom surface of ceramic member 12. A ceramic disc 46 has a hole 48 in which is secured a cathode tube 50 on the end of which is secured a cathode cap 52. Tube 50 is tightly secured in ceramic disc 46 via the formation of beadings 54 in tube 50. Beadings 54 are tightly pressed against the surfaces of ceramic disc 46 to tightly lock tube 50 thereto.

Ceramic disc 46 is positioned against flange 44 and it is secured thereagainst by flange 56 of retainer member 58 that is secured to support 42 via a press fit or welding. In this way, cathode cap 52 is accurately positioned and aligned relative to grid member 20 and aperture 22. The spacing between grid member 20 and cathode cap 52 is 0.0025 inches. The cathode cap 52 has a small diameter and tube 50 is sufficiently long to reduce capacitance. A cathode spacer 60 in the form of a metal ring of proper thickness can be placed between ceramic disc 46 and flange 44 to compensate for spacing problems due to brazing thickness and tolerances of flange 44, ceramic disc 46 and beadings 54 to make certain that cathode cap 52 is accurately positioned and aligned relative to grid member 20.

Another ceramic disc 62 has a flange 64 that abuts against the bottom of support 42 and it is secured thereagainst by tabs 66 extending outwardly from support 42 and bent against disc 62. A heater filament 68 extends along tube 50 and has its ends connected respectively to leads 70 and 72 which are secured to ceramic disc 62 via rivets 76 that are located in holes 76.

A wafer member 78 is secured onto section 34 of grid member 32 and it has tabs 80 that are secured into glass rods for mounting the cathode and grid assembly 10 thereon as part of the electron gun.

The small diameter of grid member 20, the small diameter of section 36 of grid member 32, the small diameter cathode and small diameter of grid lead 26 all combine to substantially reduce capacitance so that input signals impressed onto control grid member 20 via lead 26 will enable electron beam operation at a very high frequency without excessive loading to the grid.

Where grid member 32 is secured to surface 28 of ceramic member 14 and grid member 20 is secured to surface 16 will cause reduction in capacitance due to the distance therebetween. Accelerating grid member 32 is connected to 200–400 volts. The accurate spacing and alignment of grid members 20 and 32 relative to each other and to the cathode enables high resolution to be realized. If desired, another high inductance grid lead **26*a* of the same size as lead 26 can be connected to grid member 20, and, together with lead 26**, this arrangement can form a transmission line system for even higher frequency response.

It will be obvious to those having ordinary skill in the art that many changes may be made in the details of the above-described preferred embodiment of the present invention without departing from the spirit of the invention. For example, ceramic members 12 and 14 can be one piece. Therefore, the scope of the present invention is to be determined by the scope of the claims.

The invention is claimed in accordance with the following:

1. An electrode assembly for an electron discharge device, comprising:

an annular dielectric support member having a front face, a rear face, and a central passage formed by a frusto-conical major interior surface extending between a circular front opening adjacent said front face and a substantially smaller circular rear opening adjacent said rear face, a first, disk-shaped grid electrode, of a size not substantially exceeding that of said smaller opening, disposed overlying the smaller opening and bonded at its periphery to the support member's rear face, a second nonplanar grid electrode bonded to the support member's front face, said second electrode including a recessed portion extending into said front opening to position a central region of the second electrode in closely-spaced relation to said first grid electrode, said recessed portion having a frusto-conical surface disposed in axially-aligned, closely-spaced relation to said frust-conical interior surface of the support member, a cathode electrode having an activated, electron-emissive surface, and means, including a dielectric member bonded to the rear surface of said annular support member, mounting said cathode electrode with its electron-emissive surface closely adjacent said first grid electrode, said first and second grid electrodes each including a central aperture, the apertures of said electrodes and the electron-emissive surface of said cathode being arranged in mutual alignment.

2. The electrode assembly of claim 1, wherein the central apertures of the first and second electrodes are substantially equal in diameter.

3. The electrode assembly of claim 1, wherein the insulating member bonded to the rear surface of said annular support member is a tubular ceramic member having one end bonded to said surface adjacent the outer perimeter of said annular member.

4. The electrode assembly of claim 3, wherein said tubular member includes means defining a passage through the wall thereof at a location adjacent said one end, and wherein a high inductance electrical lead extends through said hole and connects to said first grid electrode.

5. The electrode assembly of claim 1, wherein the second electrode's recessed central region is smaller in size than the opening in the annular member's rear face.

* * * * *